US005800155A

United States Patent [19]

Miyanaga

[11] Patent Number: 5,800,155

[45] Date of Patent: Sep. 1, 1998

[54] FLAME TORCH

[76] Inventor: Tsuneo Miyanaga, 1-2-14, Midori-Cho, Kasukabe-Shi, Saitama-Ken, Japan

[21] Appl. No.: 669,811

[22] Filed: Jun. 27, 1996

[51] Int. Cl.[6] ..... F23D 11/36

[52] U.S. Cl. ..... 431/153; 431/255

[58] Field of Search ..... 431/153, 255

[56] References Cited

U.S. PATENT DOCUMENTS 5,460,520 10/1995 Lin ..... 431/255

*Primary Examiner*—Carroll B. Dority
*Attorney, Agent, or Firm*—Charles E. Baxley, Esq.

[57] ABSTRACT

A flame torch includes a casing in which a reservoir and a starter are respectively disposed, a button member disposed to the casing and receiving the starter therein, the button member having a first shoulder and a second shoulder recessedly defined therein, an extension portion connected to the starter and the reservoir respectively, an L-shaped plate disposed in the casing and having a first end thereof connected to a valve of the reservoir, a second end thereof having an extending plate, a switch slidably disposed to the casing and connected to the L-shaped plate such that when the switch together with the L-shaped plate are shifted to an open position, the extending plate is shifted accordingly and can be pushed downwardly by the second shoulder when pushing the button member downwardly so as to rotate the L-shaped plate to let the first end of the L-shaped plate to pull the valve to release the gas in the reservoir into the extension portion to be ignited.

3 Claims, 4 Drawing Sheets

FLAME TORCH

BACKGROUND OF THE INVENTION

1. Field of the Invention

The present invention relates to a flame torch and more particularly, to a flame torch with a safety means disposed thereto so as to prevent from being unintentionally ignited.

2. Brief Description of the Prior Art

A conventional flame torch is operated by actuating a starter to produce a spark to let gas jetted from a reservoir be ignited to be a flame. The starter is operated by pushing a button downwardly, however, such a design is a risk for a child, because the child could unintentionally push the button just for fun and he/she does not know there is a flame with high temperature jetted from the flame torch.

The present invention intends to provide an improved flame torch which has a safety means disposed therein such that the gas can be ignited by pushing the button downwardly unless the safety means is operated such that the above-mentioned problems are mitigate and/or obviated.

SUMMARY OF THE INVENTION

The present invention provides a flame torch which includes a casing which has a slot defined transversely therein and the casing has a first hole and a second hole defined therein. A reservoir is disposed in the casing and has a valve disposed to a top thereof.

A starter is disposed in the casing and has an extension portion which extends from the first hole of the casing, the extension portion connected to the valve of the reservoir by a tube. A button member is disposed within the second hole of the casing and receives the starter therein, the button member having a first shoulder and a second shoulder recessedly defined therein wherein the second shoulder is lower than the first shoulder and is located more closer to a side of the casing than that of the first shoulder.

An L-shaped plate is disposed above the reservoir and includes a vertical plate and a horizontal plate, the vertical plate having a third hole defined therein such that a switch which is slidably disposed within the slot is connected to the vertical plate via the slot and the third hole, a pin pivotally connected between the switch and the vertical plate. The horizontal plate has a first end and a second end, the first end connected to the valve and the second end having an extending plate extending therefrom which can be shifted to a position beneath the second shoulder by moving the switch to an open position so as to be pushed downwardly by pushing the button member downwardly to actuate the starter and release the gas in the reservoir via the valve which is pulled upwardly by the first end of the horizontal plate.

It is an object of the present invention to provide a flame torch with a safety means disposed therein.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
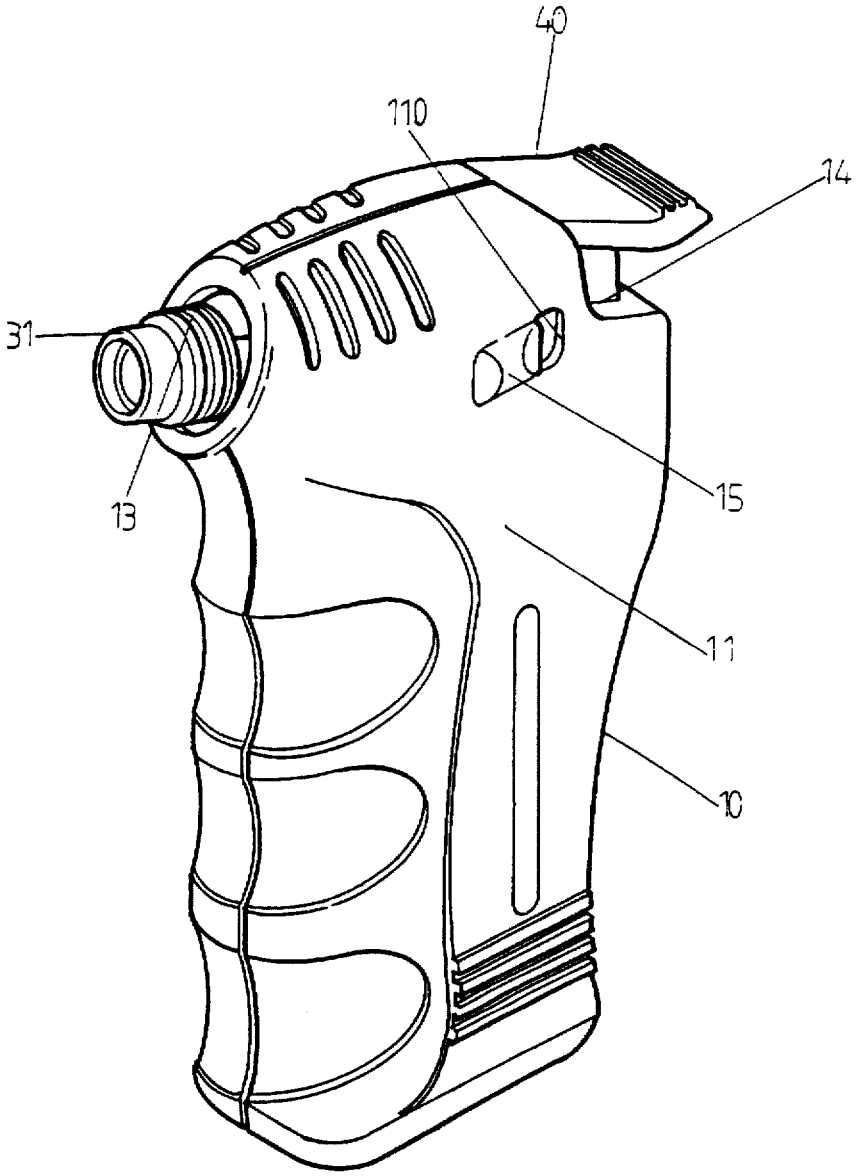
FIG. 1 is a perspective view of a flame torch in accordance with the present invention.
Figure 2:
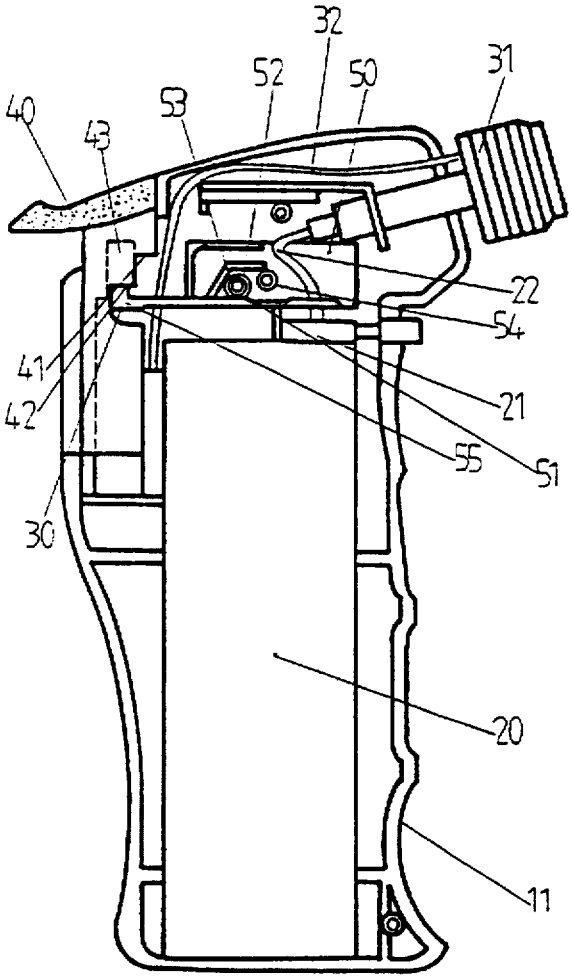
FIG. 2 is a plan view to show an arrangement of the flame torch in accordance with the present invention.
Figure 3:
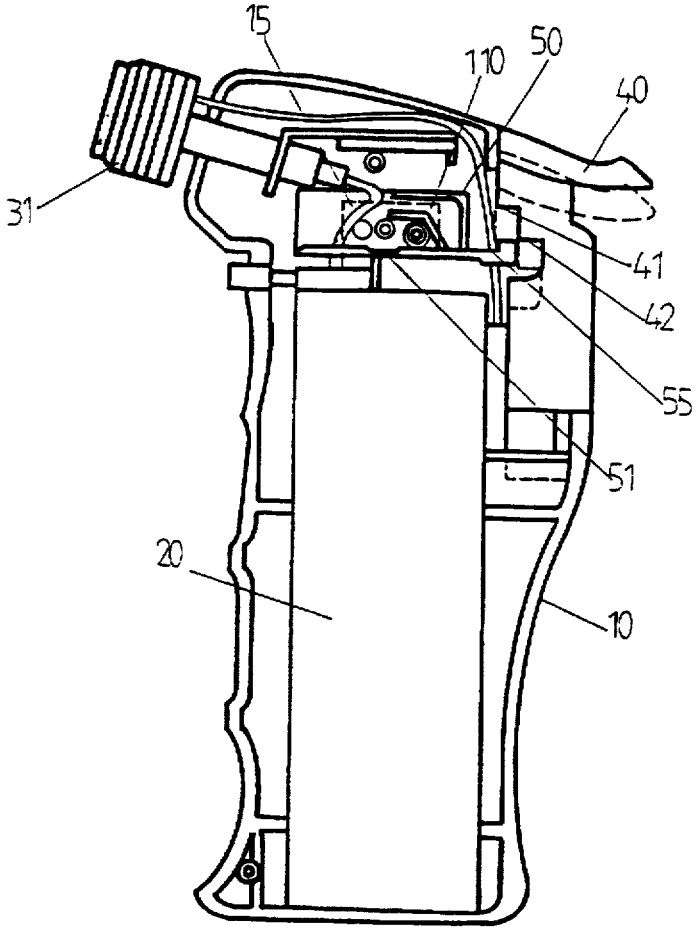
FIG. 3 is a plan view to show a position of the L-shaped plate when in a close position.

Referring to the drawings and initially to FIGS. 1 through 3, a flame torch in accordance with the present invention generally includes a casing 10 composed of a front casing 11 and a rear casing 12, the front casing 11 having a slot 110 defined transversely therein and the casing 10 having a first hole 13 defined in a first side thereof and a second hole 14 defined in a second side thereof.

A reservoir 20 is disposed in the casing 10 and has a valve 21 disposed to a top thereof. A starter 30 is disposed in the casing 10 and has an extension portion 31 which extends from, the first hole 13 of the casing 10. The extension portion 31 is connected to the valve 21 of the reservoir 20 by a tube 22 and connected to the starter 30 by a wire 32 such that when the starter 30 is actuated, a spark is produced in the extension portion 31 and gas released from the reservoir 20 can be ignited.

A button member 40 is disposed within the second hole 14 of the casing 10 and receives the starter 30 therein such that when pushing the button member 40 downwardly, the starter 30 is actuated by the downward movement of a board 43 in the button member 40. The button member 40 has a first shoulder 41 and a second shoulder 42 recessedly defined therein wherein the second shoulder 42 is positioned lower than the first shoulder 41 and is located more closer to the first side of the casing 10 than that of the first shoulder 41.

An L-shaped plate is disposed above the reservoir 20 and includes a vertical plate 50 and a horizontal plate 51, the vertical plate 50 having a third hole 52 defined therein such that a switch 15 slidably disposed within the slot 110 is connected to the vertical plate 50 by a bolt 53 via the slot 110 and the third hole 52. A pin 54 is connected between the button member 15 and the vertical plate 50 such that the vertical plate 50 can be pivoted about an axis of the pin 54. The horizontal plate 51 has a first end and a second end, the first end connected to the valve 21 and the second end having an extending plate 55 extending therefrom which extends beneath the first shoulder 41 as a close position and not yet extends beneath the second shoulder 42. Accordingly, when the button member 40 is unintentionally pushed downwardly, the starter 30 is actuated but the extending plate 55 is not pushed by the button member 40.

Figure 4:
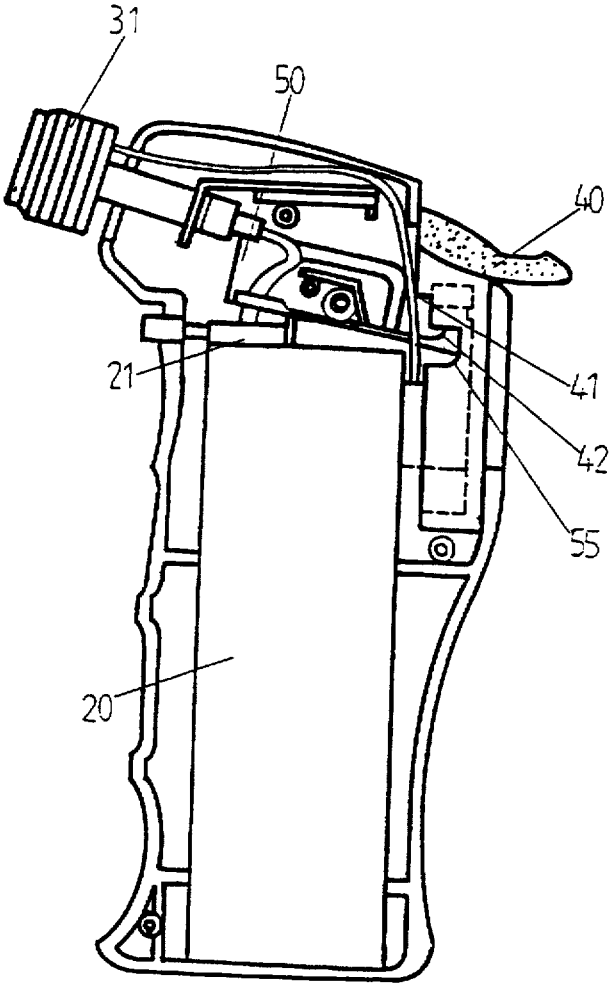
FIG. 4 is a plan view to show a position of the L-shaped plate when in an open position.

Referring to FIG. 4, when shifting the switch 15 to an open position, the extending plate 55 together with the switch 15 can be shifted to the open position and the extending plate 33 is pressed downwardly by the second shoulder when the button member 40 is pushed. A spark is then produced in the extension portion 31 and the L-shaped plate is pivoted about the pin 54 to lift the valve 21 such that gas flows to the extension portion 31 via the tube 22 and to be ignited.

Therefore, the flame torch has a safety means which includes the switch 15 and the button member 40 with the first shoulder 41 and the second shoulder 42, when the switch is in the close position, the button member 40 can be pushed but the valve 21 of the reservoir 20 is not actuated so there will be no flame produced.

Although the invention has been explained in relation to its preferred embodiment, it is to be understood that many other possible modifications and variations can be made without departing from the spirit and scope of the invention as hereinafter claimed.

What is claimed is:

1. A flame torch comprising:

a casing composed of a front casing and a rear casing, said front casing having a slot defined transversely therein and said casing having a first hole defined in a first side thereof and a second hole defined in a second side thereof;

a reservoir disposed in said casing and having a valve disposed to a top thereof;

a starter disposed in said casing and having an extension portion which extends from said first hole of said casing, said extension portion connected to said valve of said reservoir by a tube;

a button member disposed within said second hole of said casing and receiving said starter therein, said button member having a first shoulder and a second shoulder recessedly defined therein wherein said second shoulder is positioned lower than said first shoulder and is located more closer to said second side of said casing than that of said first shoulder, and an L-shaped plate disposed above said reservoir and including a vertical plate and a horizontal plate, said vertical plate having a third hole defined therein such that a switch is connected to said vertical plate via said slot and said third hole, said switch slidably disposed within said slot, a pin connected between said switch and said vertical plate, said horizontal plate having a first end and a second end, said first end connected to said valve and said second end having an extending plate extending therefrom which can be shifted to a position beneath said second shoulder by moving said switch to an open position.

2. The flame torch as claimed in claim 1 wherein said extending plate is located at a position beneath said first shoulder of said button member when in a close position.

3. The flame torch as claimed in claim 1 wherein said first end of said L-shaped plate is pulled upwardly when pushing said button member downwardly in said open position to let said L-shaped plate be pivoted corresponding to an axis of said pin wherein said second shoulder pushes said extending plate downwardly.

* * * * *